US007262225B2

(12) United States Patent
Van Berge et al.

(10) Patent No.: US 7,262,225 B2
(45) Date of Patent: Aug. 28, 2007

(54) PRODUCTION OF FISCHER-TROPSCH SYNTHESIS PRODUCED WAX

(75) Inventors: Peter Jacobus Van Berge, Vaalpark (ZA); Jan Van De Loosdrecht, Vaalpark (ZA); Sean Barradas, Parys (ZA)

(73) Assignee: Sasol Technology (Proprietary) Limited, Johannesburg (ZA)

( * ) Notice: Subject to any disclaimer, the term of this patent is extended or adjusted under 35 U.S.C. 154(b) by 0 days.

(21) Appl. No.: 10/480,753

(22) PCT Filed: Jul. 26, 2002

(86) PCT No.: PCT/IB02/02911

§ 371 (c)(1),
(2), (4) Date: May 11, 2004

(87) PCT Pub. No.: WO03/012008

PCT Pub. Date: Feb. 13, 2003

(65) Prior Publication Data

US 2004/0186188 A1 Sep. 23, 2004

(30) Foreign Application Priority Data

Jul. 27, 2001 (ZA) ..... 2001/6213

(51) Int. Cl.
*C07C 27/00* (2006.01)

(52) U.S. Cl. ..... 518/715; 518/712; 518/713; 518/714; 518/717

(58) Field of Classification Search ..... 518/700, 518/712–715, 717
See application file for complete search history.

(56) References Cited

U.S. PATENT DOCUMENTS

| | | | | |
|---|---|---|---|---|
| 4,499,197 | A | 2/1985 | Seese et al. | |
| 4,590,289 | A | 5/1986 | Albert et al. | |
| 5,733,839 | A | 3/1998 | Espinoza et al. | |
| 6,590,002 | B2 * | 7/2003 | Wittenbrink et al. | 518/715 |
| 6,638,889 | B1 * | 10/2003 | Van Berge et al. | 502/300 |

FOREIGN PATENT DOCUMENTS

| | | | |
|---|---|---|---|
| EP | 0 450 861 | A | 10/1991 |
| WO | 99 42214 | | 8/1999 |
| WO | 00/20116 | | 4/2000 |
| WO | 00/45948 | | 8/2000 |
| WO | 01 76735 | A | 10/2001 |
| WO | 02 07883 | A | 1/2002 |
| ZA | 98/2709 | | 3/1998 |

* cited by examiner

*Primary Examiner*—J. Parsa
(74) *Attorney, Agent, or Firm*—Ladas & Parry LLP

(57) ABSTRACT

A process for preparing and using a cobalt slurry phase Fischer-Tropsch synthesis catalyst includes introducing a modifying component Mc into a catalyst support precursor, followed by shaping and calcination, to obtain a catalyst support. The catalyst support is impregnated with an aqueous solution of a cobalt salt, to form an impregnated support which is partially dried and calcined, to obtain a catalyst precursor. The catalyst precursor is reduced to form a cobalt slurry phase Fischer-Tropsch synthesis catalyst. A synthesis gas is contacted with this catalyst in a slurry phase Fischer-Tropsch synthesis reaction at elevated temperature and elevated pressure, and a clean wax product that contains less than 50 mass ppm submicron particulates of cobalt is obtained.

6 Claims, 3 Drawing Sheets

PRODUCTION OF FISCHER-TROPSCH SYNTHESIS PRODUCED WAX

FIELD OF THE INVENTION

THIS INVENTION relates to the production of Fischer-Tropsch synthesis produced wax. It relates in particular to a process for producing a clean wax product, and to the use of a cobalt slurry phase Fischer-Tropsch synthesis catalyst in such a process.

BACKGROUND OF THE INVENTION

It is known from the prior art that clean wax products, ie wax products containing less than 50 mass ppm total cobalt, can be obtained during slurry phase Fischer-Tropsch synthesis involving contacting a synthesis gas comprising hydrogen and carbon monoxide at elevated temperature and pressure with a particulate supported cobalt Fischer-Tropsch synthesis catalyst, to produce the clean wax products. The clean wax product can be defined as being the filtrate of the liquid Fischer-Tropsch synthesis product (ie reactor wax) continuously extracted directly from the reactor slurry phase through an in-situ primary filtration process. The particulate supported cobalt slurry phase Fischer-Tropsch synthesis catalysts are sufficiently strong so that little break-up thereof during extended slurry phase Fischer-Tropsch synthesis runs takes place, and cobalt crystallites are sufficiently anchored to the catalyst support to prevent cobalt from readily dislodging and washing out of the cobalt catalyst during such extended slurry phase Fischer-Tropsch synthesis runs conducted at realistic conditions, also implying catalyst stability in the associated hydrothermal environment.

This objective is successfully achieved in the prior art through the introduction, during production of a catalyst precursor from which the catalyst is obtained, of additional processing step(s) to modify an already pre-shaped catalyst support, such as $Al_2O_3$, MgO or $TiO_2$, thus producing a modified catalyst support, wherein the cobalt crystallites are sufficiently anchored to the selected catalyst support to prevent cobalt from readily dislodging and washing out of the resultant cobalt catalyst during the extended slurry phase Fischer-Tropsch synthesis runs. Such a catalyst is preferably prepared through the aqueous phase impregnation of the modified catalyst support with cobalt.

SUMMARY OF THE INVENTION

The known slurry phase Fischer-Tropsch synthesis processes involving the use of the cobalt slurry phase Fischer-Tropsch synthesis catalysts hereinbefore described, suffer from the drawback that additional processing steps are required to modify the already pre-shaped catalyst supports. It is hence an object of this invention to provide a process for producing a clean wax product, ie a wax product having less than 50 mass ppm total cobalt, whereby this drawback is eliminated or at least reduced.

Thus, according to a first aspect of the invention, there is provided a process for producing a clean wax product, which process includes contacting, at an elevated temperature between 180° C. and 250° C. and at an elevated pressure between 10 bar and 40 bar, a synthesis gas comprising hydrogen and carbon monoxide with a cobalt slurry phase Fischer-Tropsch synthesis catalyst obtained from a successful catalyst support, in a slurry phase Fischer-Tropsch synthesis reaction, to produce a clean wax product containing less than 50 mass ppm submicron particulates of cobalt.

In this specification, 'a successful catalyst support' is defined as a catalyst support obtained by means of a catalyst support preparation step into which is integrated a catalyst support modification step and a pre-shaping step, ie the catalyst support modification step and the catalyst pre-shaping step both take place during preparation of the catalyst support. In other words, the catalyst support modification is not effected as a separate step after the preparation of the catalyst support has been completed.

In the preparation of the successful catalyst support, a modifying component Mc, where Mc is any element of the Periodic Table that increases the inertness of a catalyst support towards dissolution in an aqueous environment during cobalt impregnation or hydrothermal attack during Fischer-Tropsch synthesis, is introduced onto the catalyst support, followed by calcination of the thus modified catalyst support. The cobalt slurry phase Fischer-Tropsch synthesis catalyst is then produced from the successful catalyst support by impregnating the successful catalyst support with an aqueous solution of a cobalt salt, to form an impregnated support; partially drying the impregnated support; calcining the partially dried impregnated support, to obtain a catalyst precursor; and reducing the catalyst precursor to form the cobalt slurry phase Fisher-Tropsch synthesis catalyst.

The modifying component, Mc, is preferably selected from (i) Si, Co, Ce, Cu, Zn, Ba, Ni, Na, K, Ca, Sn, Cr, Fe, Li, Tl, Sr, Ga, Sb, V, Hf, Th, Ge, U, Nb, Ta, W, La and mixtures thereof; and/or from (ii) Ti in combination with at least one of Si, Co, Ce, Cu, Zn, Ba, Ni, Na, K, Ca, Sn, Cr, Fe, Li, Tl, Sr, Ga, Sb, V, Hf, Th, Ge, U, Nb, Ta, W, and La.

The modifying component, Mc, that is present in the successful catalyst support thus serves to render the catalyst support, eg $Al_2O_3$, $TiO_2$, MgO or ZnO, which is normally partially soluble in an acid aqueous solution and/or in a neutral aqueous solution, less soluble or more inert in the acid aqueous solution and/or in the neutral aqueous solution.

The introduction of the modifying component, Mc, onto the catalyst support may be effected by incorporating the modifying component into a precursor of the catalyst support. This may include contacting a precursor of the modifying component, Mc, with the catalyst support precursor, for example, by means of doping, co-gelling or precipitation. The modifying component precursor may be a salt or an alkoxide of the modifying component or components. Examples of alumina catalyst support precursors are boehmite, gibbsite, bayerite, sodium aluminate, aluminium nitrate, and aluminium tributoxide. Examples of titania catalyst support precursors are titanium tert-butoxide and hydrated titanium hydroxide (TiO(OH) or $TiO_2.H_2O$). Examples of magnesia support precursors are magnesium hydroxide ($Mg(OH)_2$) and magnesium carbonate. Examples of zinc oxide support precursors are $ZnSO_4$ and $ZnCl_2$.

In one embodiment of the invention, the successful catalyst support may be prepared in accordance with the process for manufacture of alumina silicates as described in DE 3839580, which is hence incorporated herein by reference. Thus, it may be prepared by hydrolyzing an aluminium alkoxide, obtained from an alkoxide process, eg the Ziegler ALFOL process or the Sasol Chemie (formerly Condea) "o n-purpose" proprietary process, as described in German Patent No. DE 3244972, at about 90° C. Thereafter, a dilute solution of orthosilicic acid may be added to the stirred mixture. This slurry can then be spray dried at 300° C. to 600° C. to obtain a product known as Siral (trademark), which can be tailored through calcination, to obtain a product known as Siralox (trademark), which is a successful catalyst support. Siral and Siralox are proprietary products of Sasol Germany GmbH.

In another embodiment of the invention, the precursor of the modifying component may be an inorganic cobalt compound so that the modifying component is cobalt (Co). The inorganic cobalt precursor, when used, may be a cobalt salt, eg $Co(NO_3)_2.6H_2O$, which can be mixed into a slurry, eg a boehmite slurry obtained from the alkoxide process, gelled by the addition of nitric acid, and spray dried.

The modified catalyst support may then be calcined at a temperature of from 400° C. to 900° C., preferably from 600° C. to 800° C., and for a period of from 1 minute to 12 hours, preferably from 1 hour to 4 hours.

The method of forming the catalyst precursor may be in accordance with that described in U.S. Pat. No. 5,733,839, WO 99/42214, and/or WO 00/20116, which are thus incorporated herein by reference. Thus, the impregnation of the successful catalyst support with the active catalyst component, ie the cobalt, or its precursor aqueous solution, may comprise subjecting a slurry of the catalyst support, water and the active catalyst component or its precursor to a sub-atmospheric pressure environment, drying the resultant impregnated carrier under a sub-atmospheric pressure environment, and calcining the dried impregnated carrier, to obtain the catalyst precursor.

If a higher catalyst cobalt loading is required, then a second or even a third impregnation, drying, and calcination step may thereafter be carried out after the first impregnation, drying, and calcination step hereinbefore described.

During the slurry phase cobalt impregnation step(s), a water soluble precursor salt of Pt or Pd, or mixtures of such salts, may be added, as a dopant capable of enhancing the reducibility of the active component. The mass proportion of this dopant, when used, to cobalt may be between 0.01:100 and 0.3:100.

The process may include subjecting the wax product that is produced, to primary separation to separate the wax product from the catalyst. A serious problem that may arise when utilizing a cobalt slurry phase Fischer-Tropsch synthesis catalyst, not being a cobalt slurry phase Fischer-Tropsch synthesis catalyst prepared according to the invention, as observed during larger scale pilot plant slurry phase Fischer-Tropsch synthesis runs, is the undesired high cobalt (submicron particulates of cobalt) content of the wax product. Typically, the wax product may contain contamination levels of such cobalt in excess of 50 mass ppm, even after secondary ex-situ filtration through a Whatman no. 42 (trademark) filter paper (the product of such filtration is hereinafter referred to as 'secondary filtered reactor wax'). Due to the high cost of cobalt and the contamination and poisoning of downstream hydroconversion processes, this is a highly undesirable problem which has thus been solved, or at least alleviated, with this invention. Also, the use of extensive and expensive polishing steps of the primary filtered wax product is not necessary. The said $Al_2O_3$, $TiO_2$, MgO or ZnO based catalyst supports are thus modified and pre-shaped during the catalyst support preparation step, a process that may include spray-drying and calcination, in order to increase inertness of the catalyst support in an aqueous (neutral or acidic) environment during the cobalt nitrate impregnation step, and thus prevent the formation of cobalt-rich ultra fine or submicron particulates during slurry phase Fischer-Tropsch synthesis.

During the primary separation, separation of catalyst particles, which have sizes in the order of between 10-200 micron, from the wax product, is effected to produce primary filtered wax. The process is thus characterized thereby that it does not include any, or any significant, separation of particles of submicron size from the wax product.

The clean wax product, ie the hydrocarbons produced by the slurry hydrocarbon synthesis process of the invention, may typically be upgraded to more valuable products, by subjecting all or a portion of the clean wax product to fractionation and/or conversion. By 'conversion' is meant one or more operations in which the molecular structure of at least a portion of the hydrocarbon is changed and includes both non-catalytic processing (eg steam cracking), and catalytic processing (eg catalytic cracking) in which a fraction is contacted with a suitable catalyst. If hydrogen is present as a reactant, such process steps are typically referred to as hydroconversion and include, for example, hydroisomerization, hydrocracking, hydrodewaxing, hydrorefining and hydrotreating, all conducted at conditions well known in the literature for hydroconversion of hydrocarbon feeds, including hydrocarbon feeds rich in paraffins. Illustrative, but non-limiting, examples of more valuable products formed by conversion include one or more of synthetic crude oils, liquid fuel, olefins, solvents, lubricating, industrial or medicinal oils, waxy hydrocarbons, nitrogen and oxygen containing hydrocarbon compounds, and the like. Liquid fuel includes one or more of motor gasoline, diesel fuel, jet fuel, and kerosene, while lubricating oil includes, for example, automotive, jet, turbine and metal working oils. Industrial oils includes well drilling fluids, agricultural oils, heat transfer fluids and the like.

According to a second aspect of the invention, there is provided the use of a cobalt slurry phase Fischer-Tropsch synthesis catalyst obtained from a successful catalyst support, in a process for producing a clean wax product, by contacting, at an elevated temperature between 180° C. and 250° C. and at an elevated pressure of between 10 bar and 40 bar, a synthesis gas comprising hydrogen and carbon monoxide with the catalyst, in a slurry phase Fischer-Tropsch synthesis reaction, to produce a clean wax product containing less then 50 mass ppm submicron particulates of cobalt.

The invention will now be described in more detail with reference to the following non-limiting examples and the accompanying drawings.

DETAILED DESCRIPTION

EXAMPLE 1

In the example, two catalyst supports, and supported cobalt slurry phase Fischer-Tropsch synthesis catalysts obtained therefrom, are compared:

Puralox Catalyst support: This catalyst support is that obtainable under the trademark Puralox SCCa 2/150 from SASOL Germany GmbH of Üb erseering 40, 22297, Hamburg, Germany. It is a pure gamma-alumina support, and is prepared by calcination of boehmite (AlO(OH)) at 750° C.

Siralox 1.5 Catalyst support: A successful catalyst support was prepared by hydrolyzing an aluminium alkoxide, obtained from the alkoxide process eg the Ziegler ALFOL process or the Sasol Chemie (formerly Condea) "o n-purpose" proprietary process as described in German Patent No. DE 3244972, at 90° C. Thereafter, a dilute solution of orthosilicic acid was added to the stirred mixture. This slurry was then spray dried at 300° C. to 600° C. to obtain the trademark product: Siral, which was tailored through calcination at between 600° C. and 1100° C., to obtain the trademark product: Siralox, which is a Sasol Germany GmbH proprietary product. The composition of Siralox 1.5 is 1.5 $SiO_2$/100 $Al_2O_3$ (m/m).

1.1 Conductivity Measurements

Alumina dissolves in an aqueous medium at low pH. The dissolution of alumina results in the formation of aluminium ions. As more alumina dissolves, the concentration of aluminium ions increases with time. The increase of aluminium ions with time was monitored by measuring conductivity at a constant pH of 2. The pH was kept constant by automated addition of a 10% nitric acid solution. The results are set out in FIG. 1.

Figure 1:
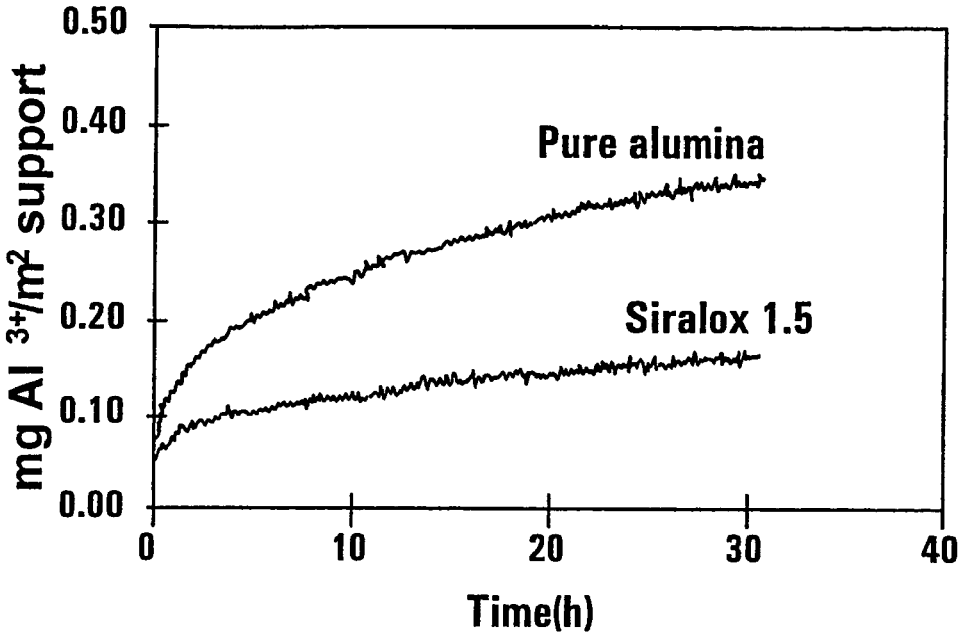
FIG. 1 shows cumulative dissolution profiles of a pure pre-shaped alumina catalyst support (Puralox SCCa) and a silica modified catalyst support (Siralox 1.5 support), at a solids concentration of 2% (w/w)

In FIG. 1, the cumulative mg Al dissolved per $m^2$ fresh catalyst support is plotted against time. It can be seen that the unprotected pure alumina (Puralox catalyst support) dissolves faster than the successful silica modified alumina (Siralox 1.5 catalyst support).

1.2 Catalyst Preparation

Catalyst A

A supported cobalt catalyst precursor was prepared on the Siralox 1.5 successful catalyst support with a porosity of 0.46 ml/g, as catalyst support material. A solution of 17.4 kg of $Co(NO_3)_2.6H_2O$, 9.6 g of $(NH_3)_4Pt(NO_3)_2$, and 11 kg of distilled water was mixed with 20.0 kg of the Siralox 1.5 successful catalyst support, by adding the successful catalyst support to the solution. The slurry was added to a conical vacuum drier and continuously mixed. The temperature of this slurry was increased to 60° C. after which a pressure of 20 kPa (a) was applied. During the first 3 hours of the drying step which commenced when the pressure of 20 kPa(a) was applied, the temperature was increased slowly and reached 95° C. after the 3 hours. After the 3 hours the pressure was decreased to 3-15 kPa(a), and a drying rate of 2.5 m %/h at the point of incipient wetness was used. The complete impregnation and drying step took 9 hours, after which the impregnated and dried catalyst support was immediately and directly loaded into a fluidized bed calciner. The temperature of the dried impregnated catalyst support was about 75° C. at the time of loading into the calciner. The loading took about 1 to 2 minutes, and the temperature inside the calciner remained at its set point of about 75° C. The impregnated and dried material was heated from 75° C. to 250° C., using a heating rate of 0.5° C./min and an air space velocity of 1.0 $m^3_n$/kg $Co(NO_3)_2.6H_2O$/h, and kept at 250° C. for 6 hours. To obtain a catalyst with a cobalt loading of 30 g Co/100 g $Al_2O_3$, a second impregnation/drying/calcination step was performed. A solution of 9.4 kg of $Co(NO_3)_2.6H_2O$, 15.7 g of $(NH_3)_4Pt(NO_3)_2$, and 15.1 kg of distilled water was mixed with 20.0 kg of the ex first impregnation and calcination intermediate material, by adding this material to the solution. The slurry was added to a conical vacuum drier and continuously mixed. The temperature of this slurry was increased to 60° C. after which a pressure of 20 kPa(a) was applied. During the first 3 hours of the drying step, the temperature was increased slowly and reached 95° C. after 3 hours. After 3 hours the pressure was decreased to 3-15 kPa(a), and a drying rate of 2.5 m %/h at the point of incipient wetness was used. The complete impregnation and drying step took 9 hours, after which the impregnated and dried intermediate material was immediately and directly loaded into the fluidized bed calciner. The temperature of the dried impregnated intermediate material was about 75° C. at the time of loading into the calciner. The loading took about 1 to 2 minutes, and the temperature inside the calciner remained at its set point of about 75° C. The impregnated and dried intermediate material was heated from 75° C. to 250° C., using a heating rate of 0.5° C./min and an air space velocity of 1.0 $m^3_n$/kg $Co(NO_3)_2.6H_2O$/h, and kept at 250° C. for 6 hours. The resultant 30 g Co/100 g $Al_2O_3$ catalyst precursor was activated, ie reduced in a pure hydrogen environment in an atmospheric pressure fluidized bed at an elevated temperature of 425° C., to obtain a cobalt slurry phase Fischer-Tropsch synthesis catalyst (catalyst A).

Catalyst B

A supported cobalt catalyst precursor was prepared in a similar manner to that described for catalyst A, except that the catalyst precursor was prepared on the pure alumina pre-shaped support, Puralox SCCa 2/150. The resultant catalyst precursor was also reduced in a pure hydrogen environment in an atmospheric pressure fluidized bed at an elevated temperature of 425° C., to obtain the cobalt slurry phase Fischer-Tropsch synthesis catalyst (catalyst B).

1.3 Pilot Plant Slurry Phase Fischer-Tropsch Synthesis Test

Figure 2:
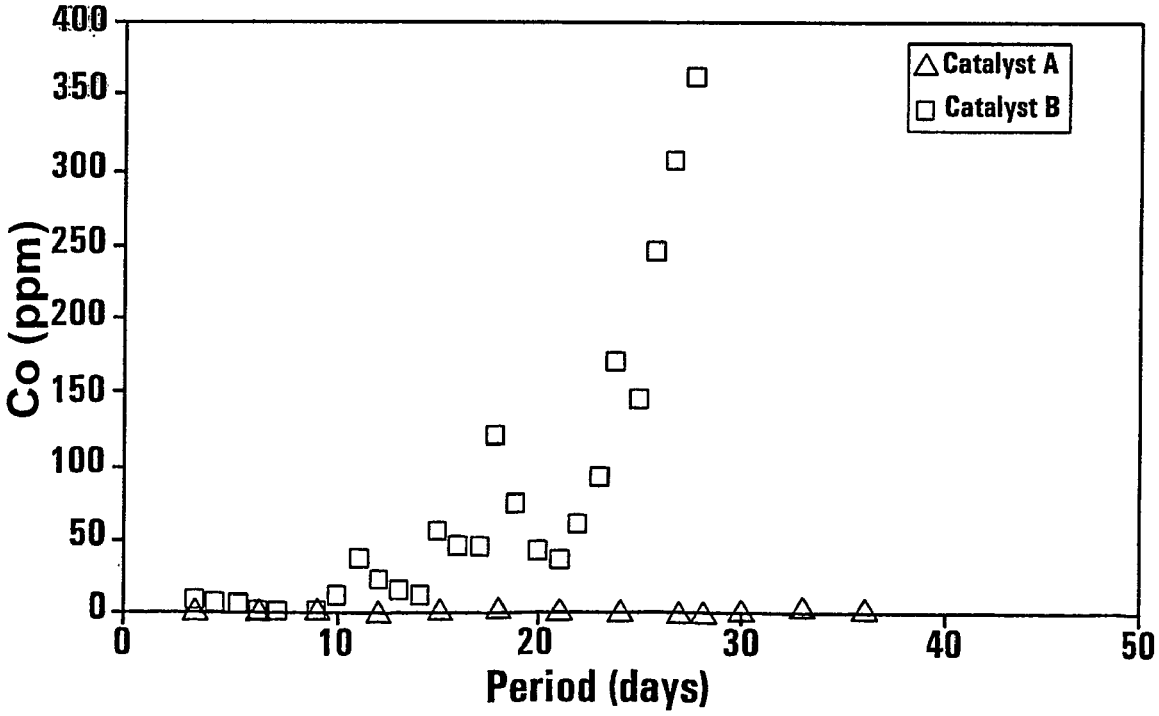
FIG. 2 depicts the cobalt contamination level of secondary filtered wax product as a function of Fischer-Tropsch slurry phase synthesis time on stream, as observed on Pilot Plant scale. Cobalt supported Fischer-Tropsch synthesis catalysts were compared with catalysts supported as follows: (i) a pure pre-shaped alumina particulate catalyst support known by the trademark: Puralox SCCa, as supplied by SASOL Germany GmbH, (catalyst B), and (ii) a pre-shaped silica modified alumina catalyst support known by the trademark: Siralox 1.5, as supplied by SASOL Germany GmbH (catalyst A), which is in accordance with the invention.

During a confidential Pilot Plant slurry phase Fischer-Tropsch synthesis test run, using 5 kg of the catalyst prepared on unmodified alumina, ie catalyst B, in a 11 m high bubble column reactor with an external recycle, the secondary filtered reactor wax product turned grey after about 10 days on-line and the cobalt content increased to 350 mass ppm after 25 days on line, as shown in FIG. 2. Pilot Plant scale Fischer-Tropsch synthesis test runs were performed under realistic conditions:

| | |
|---|---|
| Reactor temperature: | 230° C. |
| Reactor pressure: | 20 Bar |
| % ($H_2$ + CO) conversion: | 50–70% |
| Feed gas composition: | |
| $H_2$: | about ('ca') 50 vol % |
| CO: | ca 25 vol % |
| Balance: | Ar, $N_2$, $CH_4$ and/or $CO_2$ |

A similar confidential Pilot Plant slurry phase Fischer-Tropsch synthesis test run was also performed on catalyst A, and showed a substantial improvement with respect to the submicron cobalt particulate contamination in the secondary filtered reactor wax product (FIG. 2). After 38 days on stream, the cobalt contamination level of the secondary filtered reactor wax product was still within the specification of <50 mass ppm.

From the Pilot Plant slurry phase Fischer-Tropsch synthesis tests, it can be seen that the improvement of the inertness of the alumina catalyst support by modifying it with silica, as shown by conductivity measurements, also prevented the formation of sub-micron cobalt rich particulates during slurry phase Fischer-Tropsch synthesis in the absence of catalyst break-up.

1.4 Laboratory Slurry Phase Fischer-Tropsch Synthesis

The cobalt catalyst precursors were reduced (as hereinbefore described) prior to Fischer-Tropsch synthesis in a tubular reactor at a hydrogen space velocity of 200 ml hydrogen/(g catalyst.h) and atmospheric pressure. The temperature was increased to 425° C. at 1° C./min, after which isothermal conditions were maintained for 16 hours.

Between 10 g and 30 g of the resultant particulate catalyst, with the catalyst particles ranging from 38 μm to 150 μm, was suspended in 300 ml molten wax and loaded in a CSTR with an internal volume of 500 ml. The feed gas comprised hydrogen and carbon monoxide in a $H_2$/CO molar ratio of from 1.5/1 to 2.3/1. This reactor was electrically heated and sufficiently high stirrer speeds were employed so as to eliminate any gas-liquid mass transfer limitation. The feed flow was controlled by means of Brooks mass flow controllers, and space velocities ranging from 2 to 4 $m^3_n/(kg_{cat}hr)$ were used. GC analyses of the permanent gases as well as the volatile overhead hydrocarbons were used in order to characterize the product spectra.

The catalysts, ie the reduced, or activated precursors, were tested under realistic Fischer-Tropsch synthesis conditions:

| | |
|---|---|
| Reactor temperature: | 220° C. |
| Reactor pressure: | 20 Bar |
| % ($H_2$ + CO) conversion: | 50–70% |
| Feed gas composition: | |
| $H_2$: | ca 50 vol % |
| CO: | ca 25 vol % |
| Balance: | Ar, $N_2$, $CH_4$ and/or $CO_2$ |

Having applied a reported cobalt based Fischer-Tropsch kinetic equation, such as:

$$r_{FT}=(k_{FT}P_{H2}P_{CO})/(1+KP_{CO})^2$$

the Arrhenius derived pre-exponential factor of $k_{FT}$ was estimated for each of the reported runs. By defining the relative intrinsic Fischer-Tropsch activity as (pre-exponential factor of catalyst X after reduction test)/(pre-exponential factor of the baseline catalyst B), where X is catalyst A or B, the intrinsic Fischer-Tropsch activities of the cobalt catalysts could be compared. The relative intrinsic Fischer-Tropsch activity is determined after 15 hours on stream (Table 1). It is clear that support modification did not influence the intrinsic Fischer-Tropsch performance characteristics when compared to the pure alumina supported cobalt catalyst, Catalyst B.

TABLE 1

Laboratory CSTR Fischer-Tropsch synthesis performance comparison between catalysts prepared on a pure alumina catalyst support (catalyst B) and a Siralox 1.5 successful catalyst support (catalyst A).

| | Catalyst A | Catalyst B |
|---|---|---|
| | Run Number | |
| | 163F | 130$ |
| Synthesis conditions: | | |
| Calcined catalyst mass (g) | 20.5 | 20.6 |
| Reactor temp (° C.) | 219.3 | 221.0 |
| Reactor pressure (bar) | 20.0 | 20.0 |
| Time on stream (h) | 15.5 | 15.0 |
| Feed gas composition: | | |
| $H_2$ (vol %) | 53.2 | 52.2 |
| CO (vol %) | 27.2 | 26.4 |
| (Balance = Ar, $CH_4$ + $CO_2$) | | |
| Syngas ($H_2$ + CO) space velocity ($m;_n/(kg_{cat}hr)$) | 3.8 | 3.0 |
| Reactor partial pressures (bar) | | |
| $H_2$ | 5.7 | 4.5 |
| CO | 3.1 | 2.5 |
| $H_2O$ | 4.2 | 4.8 |
| $CO_2$ | 0.2 | 0.3 |
| Synthesis performance | | |
| Conversion: % syngas | 60.1 | 68.3 |
| Relative intrinsic FT activity | 1.1 | 1.0 |
| % CO of total amount of CO converted to $CO_2$ | 1.5 | 3.1 |
| % C-atom $CH_4$ selectivity | 4.0 | 4.3 |

EXAMPLE 2

The following modified or successful alumina supports were prepared by Sasol Germany GmbH of Üb erseering 40, 22297, Hamburg, Germany by doping of an alumina precursor (boehmite, ie AlO(OH)) before spraydrying (shaping). The modified supports were then calcined in a furnace at 750° C.:

Modified support A: doped with 1.5 m % $WO_3$.

Modified support B: doped with a mixture of 1.5 m % $TiO_2$ and 1.5 m % $SiO_2$.

Modified support C: doped with 1.5 m % BaO.

Modified support D: doped with 4 m % Ce.

Figure 3:
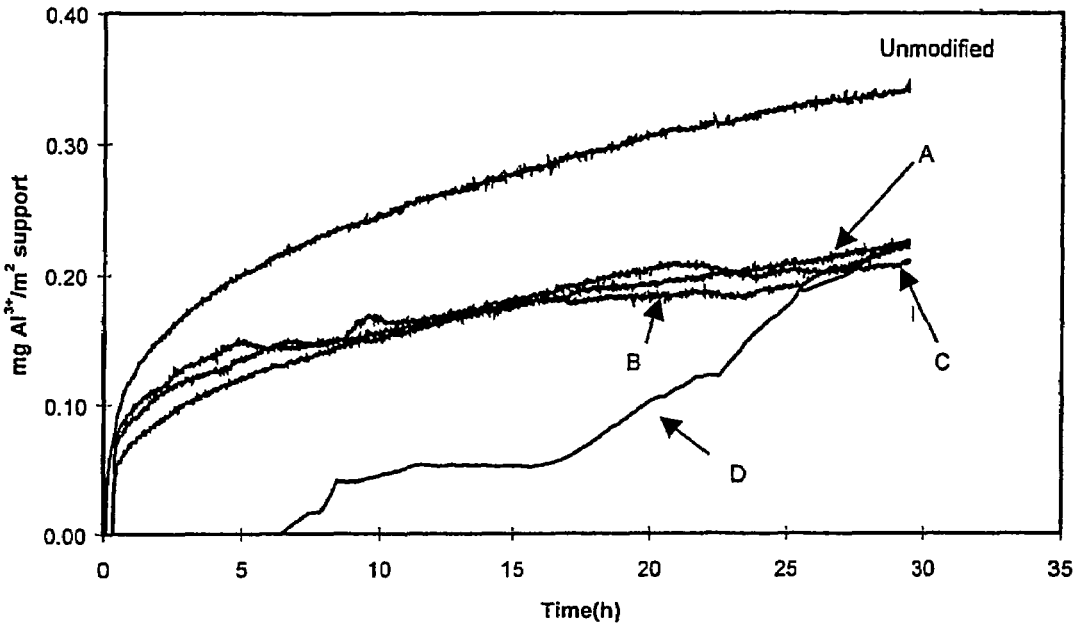
FIG. 3 shows cumulative dissolution profiles of a pure pre-shaped alumina catalyst support (Puralox SCCa) and doped alumina catalyst supports, A, B, C and D, at a solids concentration of 2% (w/w). Modified support A is an alumina modified support doped with 1.5 m % $WO_3$. Modified support B is an alumina modified support doped with a mixture of 1.5 m % $TiO_2$ and 1.5 m % $SiO_2$. Modified support C is an alumina modified support doped with 1.5 m % BaO. Modified support D is an alumina modified support doped with 4 m % Ce.

Conductivity measurements were performed on these samples under similar conditions as described in Example 1. The results are shown in FIG. 3, is clearly demonstrating that the modification of alumina, as a catalyst support, with W, a mixture of Ti and Si, Ba and Ce effects an alumina dissolution suppression similar to that of Si as a proved successful alumina support modifier.

EXAMPLE 3

The more preferred catalyst supports for cobalt based Fischer-Tropsch synthesis catalysts are alumina, titania, magnesium oxide and zinc oxide.

Particulate titanium dioxide (Degussa P25 (trademark)) support was spraydried and calcined for 16 hours at 650° C. The support had a surface area of 45 $m^2/g$. A magnesium oxide support, as supplied by MERCK, had a surface area of 88 $m^2/g$. Zinc oxide pellets, as supplied by Süd Chemie, were crushed and sieved to obtain a fraction between 38 and 150 μm. The resultant zinc oxide support had a surface area of 50 $m^2/g$.

Figure 4:
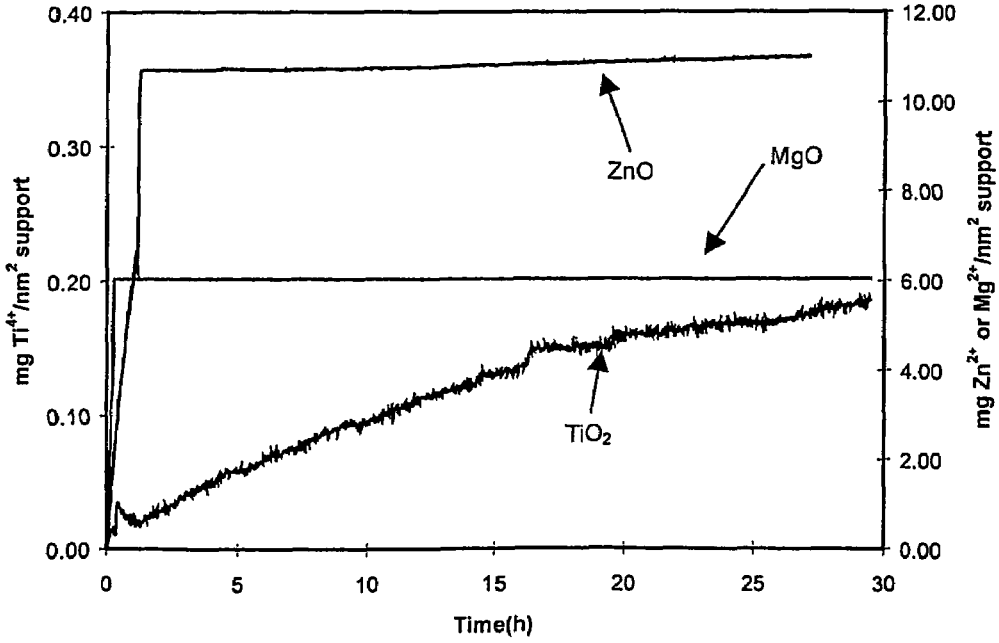
FIG. 4 shows cumulative dissolution profiles of various pure catalyst supports at a solids concentration of 2% (w/w)

The dissolution profiles of these supports were determined, and are shown in FIG. 4.

MgO and ZnO completely dissolved in the aqueous/acidic solution during the dissolution test, as indicated by the levelling off of the dissolution profile after 1 hour on-line. Both conductivity solutions after the test did not contain any solid residue and the solutions were clear. The $TiO_2$ catalyst support only partially dissolved. These experiments show that the use of pure or unmodified catalyst supports in an aqeuous acidic solution will result in the dissolution thereof.

EXAMPLE 4

2 kg of a particulate $TiO_2$ support (obtainable from Degussa AG, under the trademark 'P25') was redispersed in 10 kg water and 220 g of a silica precursor, TEOS (tetra ethoxy silane), was added to the mixture, and this mixture was homogenised for 30 minutes. Thereafter the mixture was spraydried and calcined at 800° C. for 2 hours, and resulted in a doped silica modified or successful titania support. The silica modified titania support had a surface area of 46 $m^2/g$. Conductivity measurements were performed on the sample as described in Example 1 and the dissolution profile compared to the dissolution profile of a pure titania support (Degussa Titania P 25).

Figure 5:
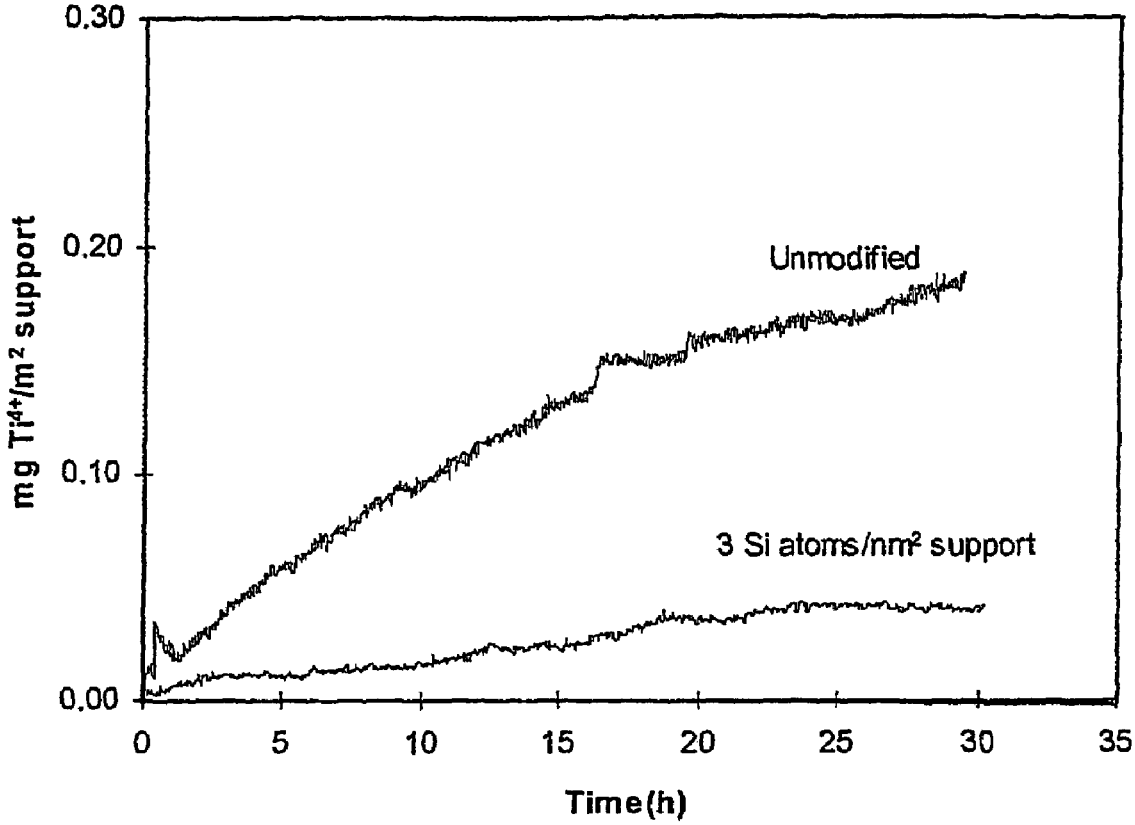
FIG. 5 shows cumulative dissolution profiles of a pure unmodified pre-shaped titania catalyst support (Degussa Titania P25 (trademark)) and a silica modified titania catalyst support, at a solids concentration of 2% (w/w)

In FIG. 5, the cumulative mg Ti dissolved per $m^2$ fresh support is plotted against time. It can be seen that the unprotected and unmodified titania. support dissolved faster than the silica modified titania support, ie the successful catalyst support.

The invention claimed is:

1. A process for producing a clean wax product, which includes the following steps in the following sequence:

introducing, in a catalyst support preparation step, a modifying component Mc, which is selected from (i) Si, Co, Ce, Cu, Zn, Ba, Ni, Na, K, Ca, Sn, Cr, Fe, Li, TI, Sr, Ga, Sb, V, Hf, Th, Ge, U, Nb, Ta, W, La and mixtures thereof; and/or from (ii) Ti in combination with at least one of Si, Co, Ce, Cu, Zn, Ba, Ni, Na, K, Ca, Sn, Cr, Fe, Li, TI, Sr, Ga, Sb, V, Hf, Th, Ge, U, Nb, Ta, W, and La, into a catalyst support precursor, followed by shaping and calcination of the catalyst support precursor, to obtain a catalyst support;

impregnating the catalyst support with an aqueous solution of a cobalt salt, to form an impregnated support;

partially drying the impregnated support;

calcining the partially dried impregnated support to obtain a catalyst precursor;

reducing the catalyst precursor to form a cobalt slurry phase Fischer-Tropsch synthesis catalyst;

contacting, at an elevated temperature between 180° C. and 250° C., at an elevated pressure between 10 bar and 40 bar, and in a slurry phase Fischer-Tropsch synthesis reaction, a synthesis gas comprising hydrogen and carbon monoxide with the cobalt slurry phase Fischer-Tropsch synthesis catalyst, and recovering a clean wax product that contains less than 50 mass ppm submicron particulates of cobalt.

2. A process according to claim 1, wherein, in the catalyst support preparation step, the introduction of the modifying component, Mc, into the catalyst support precursor includes contacting a precursor of the modifying component, Mc, with the catalyst support precursor by means of doping, co-gelling or precipitation.

3. A process according to claim 1, which includes subjecting the clean wax product to primary separation to separate the wax product from the catalyst.

4. A process according to claim 1, which includes upgrading at least a portion of the clean wax product by subjecting it to at least one hydroconversion operation.

5. A process according to claim 1, wherein the catalyst support precursor is selected from boehmite, gibbsite, bayerite, sodium aluminate, aluminium nitrate, aluminium tributoxide, titanium tert-butoxide, hydrated titanium hydroxide, magnesium hydroxide, magnesium carbonate, $ZnSO_4$ and $ZnCl_2$.

6. A process for producing a clean wax product, which includes the following steps:

providing a cobalt slurry phase Fischer-Tropsch synthesis catalyst prepared by the steps of introducing, in a catalyst support preparation step, a modifying component Mc, which is selected from (i) Si, Co, Ce, Cu, Zn, Ba, Ni, Na, K, Ca, Sn, Cr, Fe, Li, TI, Sr, Ga, Sb, V, Hf, Th, Ge, U, Nb, Ta, W, La and mixtures thereof; and/or from (ii) Ti in combination with at least one of Si, Co, Ce, Cu, Zn, Ba, Ni, Na, K, Ca, Sn, Cr, Fe, Li, TI, Sr, Ga, Sb, V, Hf, Th, Ge, U, Nb, Ta, W, and La, into a catalyst support precursor, followed by shaping and calcination of the catalyst support precursor, to obtain a catalyst support; impregnating the catalyst support with an aqueous solution of a cobalt salt, to form an impregnated support; partially drying the impregnated support; calcining the partially dried impregnated support to obtain a catalyst precursor; and reducing the catalyst precursor to form a cobalt slurry phase Fischer-Tropsch synthesis catalyst;

contacting, at an elevated temperature between 180° C. and 250° C., at an elevated pressure between 10 bar and 40 bar, and in a slurry phase Fischer-Tropsch synthesis reaction, a synthesis gas comprising hydrogen and carbon monoxide with the cobalt slurry phase Fischer-Tropsch synthesis catalyst; and recovering a clean wax product that contains less than 50 mass ppm submicron particulates of cobalt.

* * * * *